US005481069A

United States Patent [19]

Andresen et al.

[11] Patent Number: 5,481,069

[45] Date of Patent: Jan. 2, 1996

[54] RIBBON CABLE WITH TERMINAL EDGE REINFORCEMENT

[75] Inventors: Mark E. Andresen, Deerfield Beach; Jay H. Neer, Boca Raton; Richard J. Nelson, Boynton Beach, all of Fla.

[73] Assignee: International Business Machines Corporation, Armonk, N.Y.

[21] Appl. No.: 176,984

[22] Filed: Jan. 3, 1994

[51] Int. Cl.[6] ..... H01B 7/08

[52] U.S. Cl. ..... 174/117 F; 174/117 R; 439/492; 439/495

[58] Field of Search ..... 174/117 F, 117 FF, 174/117 R; 439/492, 495, 498

[56] References Cited

U.S. PATENT DOCUMENTS

| | | | |
|---|---|---|---|
| 3,082,292 | 3/1963 | Gore | 174/117 F |
| 3,864,011 | 2/1975 | Huber | 439/492 |
| 4,564,723 | 1/1986 | Lang | 174/36 |
| 4,707,568 | 11/1987 | Hoffman et al. | 174/103 |
| 4,832,621 | 5/1989 | Asai et al. | 174/117 F |
| 4,954,100 | 9/1990 | McCleerey | 174/117 F |
| 5,073,683 | 12/1991 | Anderson et al. | 174/117 FF |
| 5,089,669 | 2/1992 | Piper et al. | 174/117 M |
| 5,180,890 | 1/1993 | Pendergrass et al. | 174/117 F |

FOREIGN PATENT DOCUMENTS

| | | | |
|---|---|---|---|
| 213616 | 3/1987 | European Pat. Off. | 174/117 F |
| 100207 | 4/1990 | Japan | 174/117 F |
| 147209 | 6/1991 | Japan | 174/117 F |
| 138813 | 6/1991 | Japan | 174/117 F |
| 1390152 | 4/1975 | United Kingdom | 174/117 F |
| 2162362 | 1/1986 | United Kingdom | 174/117 F |

*Primary Examiner*—Morris H. Nimmo
*Attorney, Agent, or Firm*—Martin J. McKinley

[57] ABSTRACT

Disclosed is a multiconductor, flat, insulated ribbon cable, the cable constructed of a conventional material such as PVC with multiple conductors therein arranged in spaced apart side-by-side relation, and including axially extending terminal reinforced edges composed of a material such as PTFE or PE. The edge reinforcement may be formed by a lamination or extrusion process thereby inhibiting tearing of the edges of the material when the cable is inserted or removed from an enclosure, e.g. of a personal computer.

20 Claims, 1 Drawing Sheet

RIBBON CABLE WITH TERMINAL EDGE REINFORCEMENT

STATE OF THE PRIOR ART & SUMMARY OF THE INVENTION

1. Field of the Invention

The present invention relates to cables for the transmission of electromagnetic energy and, more particularly, to multiconductor flat or ribbon cables having edge reinforcement.

2. Description of the Prior Art

Flat or ribbon cables for the transmission of electromagnetic energy are well known in the art. As an example, U.S. Pat. No. 3,082,292 discloses an insulated ribbon cable comprised of a plurality of conductors which are coated with a polytetrafluoroethylene (PTFE). The cable is manufactured utilizing unsintered PTFE tape which is later heated sufficiently to effect melting and coalescing (sintering) into an impermeable structure.

This kind of ribbon cable is suitable in many situations where high flexibility of the cable is unnecessary. Other flat or ribbon cables which are manufactured from such materials as polyvinyl chloride (PVC) with an outer layer of polyethylene (PE) are relatively hard and stiff and lack the necessary flexibility essential in certain applications. In the instance where high flexibility is desired, a single outer layer of, for example PVC is conventionally employed.

Flexible ribbon cable assemblies are widely used today within personal computers. Typically they are employed to interconnect storage devices, such as hard drives, diskette drives, CD ROM's, tape drives, plug in function cards external (of the computer casing) connectors, and the like. This type of cable is economical and is reliable for use in manufacturing computers as well as other electrical devices requiring internal interconnection wherein the interconnection must be flexible (both to ease cable routing as well as simplifying the installation), must be economical and must be light weight.

Field data has shown, however, that there is an inherent weakness in the PVC cable once it has been installed in the system. PVC ribbon cable is susceptible to tearing when the cable is unplugged from the device, whether it occurs in the factory or in the field. The tearing occurs, for the most part, along the terminal (axially extending) laterally spaced apart edges of the cable. As shall be more fully explained hereinafter, and in accordance with the invention, by either extruding or laminating a stronger insulator such as PTFE, polyethylene or similar insulating material along the terminal edges, the places most prone to tear may be reinforced, thereby inhibiting insulation tearing along those edges without losing flexibility or otherwise impeding the ability to install and remove the cable from a structure.

The prior art does disclose the necessity for inhibiting cable crushing when the cable is subjected to high external mechanical crushing forces. For example, U.S. Pat. No. 4,707,568 to Hoffman et. al. discloses an armored power cable with edge supports. One advantage of "... locating the [sic. edge supports] on the outer ends of the row of conductors [is that] mechanical protection is provided to the sides of the cable." (col.3, lines 61–64). However, nothing in the prior art shows a ribbon cable having a tough material laminated or extruded to the outer leads to inhibit cable tearing. Cable tearing (really cable insulation tearing) predominantly occurs when removing the cable, with its associated connector, from the enclosure. Typically, the user, when removing an installed cable, tends to grasp the cable, wiggle or rock it back and forth to loosen the connector, and use the cable to pull the connector loose from the circuit board or the like. This kind of treatment causes insulation tearing along the terminal edges of the cable. Moreover, when using insulation displacement connectors (IDC's), many times pulling on the cable causes insulation to become torn because of this rough treatment.

Other prior art includes U.S. Pat. No. 4,564,723 to Lang which discloses a shielded ribbon cable which can be formed by trimming a conventional ribbon cable to expose one or both edge conductors and coating the cable with a conductive paint or extruded conductive plastic layer to form the shielded ribbon cable.

3. Summary of the Invention

Accordingly, it is a principal object of the present invention to inhibit tearing of the insulation along the terminal edges of flat ribbon cable caused by improper handling of the cable, while maintaining cable flexibility for ease of handling and cable routing within an enclosure.

Another object of the present invention is to provide an economical and light weight ribbon cable that has good connectability to insulation displacement connectors while having good electrical and thermal properties.

Still another object of the present invention is to provide a multiconductor ribbon cable which is easy to manufacture.

The objects of the present invention may be accomplished by constructing or manufacturing a multiconductor flat or ribbon cable of a conventional material such as PVC with multiple conductors therein, and including axially extending terminal reinforced edges composed of a material such as PTFE or PE, which edge reinforcement may be formed by a lamination or extrusion process thereby inhibiting tearing of the edges of the material when the cable is inserted or removed from an enclosure, e.g. of a personal computer.

Other objects and a more complete understanding of the invention may be had by referring to the following specification and claims taken in conjunction with the accompanying drawings in which:

DESCRIPTION OF THE PREFERRED EMBODIMENT

Figure 1:
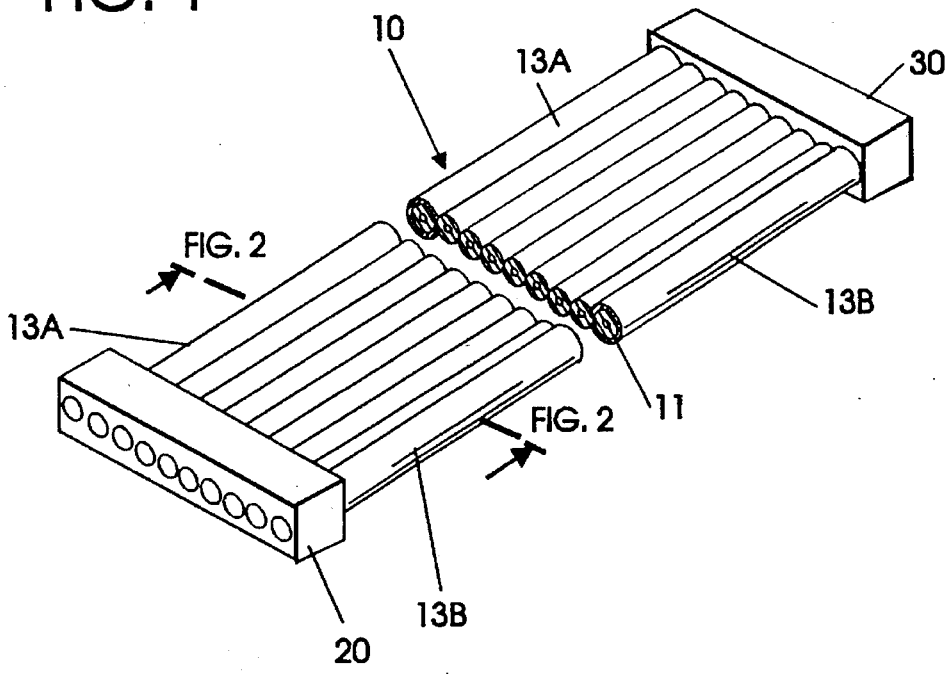
FIG. 1 is a fragmentary perspective view of a multiconductor flat or ribbon cable constructed in accordance with the present invention.
Figure 2:
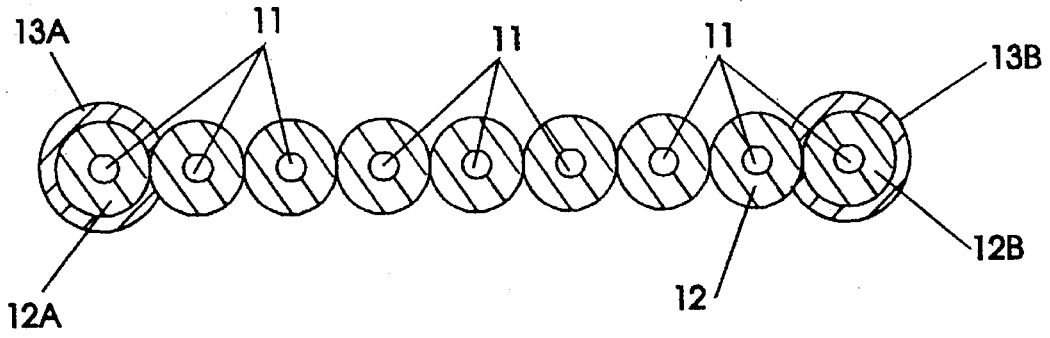
FIG. 2 is an enlarged sectional view taken along line 2—2 of FIG. 1.

Turning now to the drawing, and especially FIG. 1 thereof, a multiconductor flat or ribbon cable 10 with insulation displacement connectors 20 and 30 connected to the terminal ends of the cable 10, is illustrated therein. As is conventional, the cable includes a plurality of substantially uniformly spaced apart, axially extending conductors 11 positioned in side-by side parallel planar relationship. The conductors 11 are conventional multi-strand electrical signal carrying bare copper wires but make take multiple other forms, such as tin plated copper and various optical electromagnetic signal transmission fibers of glass or plastic.

The conductors 11 are held in spaced apart relation and electrically insulated from one another by a web of wire contour conforming insulation 12 made of a thermoplastic material such as polyvinyl chloride (PVC) and manufactured in standard insulated wire manufacturing machines.

In accordance with the invention, and in order to inhibit tearing of the insulation 12 especially under conditions of side-to-side stress imposed by wiggling the cable to loosen the connectors interiorly of an enclosure (not shown) associated with a personal computer or the like, terminal edge reinforcement means are provided. To this end, upon the axially extending, laterally spaced apart terminal insulators 12A and 12B an extra layer 13A and 13B of insulation is disposed. These layers 13A and 13B may be formed by extrusion or lamination, and are preferably formed of a tough yet somewhat flexible material such as PTFE or PE.

By limiting the layers to the terminal edges 12A and 12B of the cable 10, continued flexibility of the cable for routing within an enclosure is still maintained. Moreover, even under abuse by a user grasping the cable and wiggling it from side to side to loosen the connector 20 or 30 from where it is plugged in, the reinforced layers 13A and 13B act to strengthen the cable structure sufficiently that tearing and the like of the insulator 12 and the reinforcing layers 13A and 13B is inhibited.

Preferably, the reinforcement layers 13A and 13B should circumscribe the exposed portions of the terminal edges 12A and 12B of the outboard conductors 11. This coverage by either lamination or extrusion gives sufficient edge reinforcement to inhibit edge insulation tearing.

Although the invention has been described with a certain degree of particularity, it should be recognized, to one skilled in the art, that changes in details of fabrication may be made without departing from the spirit and scope of the invention, as hereinafter claimed.

What is claimed is:

1. A multiconductor ribbon cable for transmitting electromagnetic signals comprising:

a plurality of conductors arranged in side-by-side spaced apart and axially extending relation; said plurality of conductors including one edge conductor at each edge of the cable, a web of thermoplastic insulation material surrounding said plurality of conductors and holding said conductors in a spaced apart, electrically insulated from-one-another position; said insulation material axially extending along laterally spaced apart terminal edges covering each edge conductor;

and axially extending, laterally spaced apart, reinforcing means substantially circumscribing only exposed portions of the laterally spaced apart terminal edges of said cable said reinforcing means including a layer of insulating material extruded on the terminal, axially extending, outer edges of said multiconductor cable thereby forming said reinforcing means on said terminal edges.

2. A multiconductor ribbon cable in accordance with claim 1 wherein said axially extending, laterally spaced apart, reinforcing means comprises a layer of insulating material on said terminal edges.

3. A multiconductor ribbon cable in accordance with claim 1 wherein said reinforcing means comprises a layer of insulating material circumscribing the exposed said terminal, axially extending outer edges of said cable, and limited thereto.

4. A multiconductor ribbon cable in accordance with claim 1 including a layer of insulating material laminated on the terminal, axially extending, outer edges of said multiconductor cable thereby forming said reinforcing means on said terminal edges.

5. A multiconductor ribbon cable in accordance with claim 1 including a layer of insulating material extruded on the terminal, axially extending, outer edges of said multiconductor cable thereby forming said reinforcing means on said terminal edges.

6. A multiconductor ribbon cable in accordance with claim 1 wherein said multiconductor ribbon cable includes at least one connector associated with said cable.

7. A multiconductor ribbon cable in accordance with claim 6 wherein said at least one connector is connected to one terminal end of said cable.

8. A multicondutor ribbon cable in accordance with claim 6 including at least a second connector mounted on said cable.

9. A multiconductor ribbon cable in accordance with claim 2 wherein said multiconductor ribbon cable includes at least one connector associated with said cable.

10. A multiconductor ribbon cable in accordance with claim 9 wherein said at least one connector is connected to one terminal end of said cable.

11. A multicondutor ribbon cable in accordance with claim 9 including at least a second connector mounted on said cable.

12. A multiconductor ribbon cable in accordance with claim 3 wherein said multiconductor ribbon cable includes at least one connector associated with said cable.

13. A multiconductor ribbon cable in accordance with claim 12 wherein said at least one connector is connected to one terminal end of said cable.

14. A multicondutor ribbon cable in accordance with claim 12 including at least a second connector mounted on said cable.

15. A multiconductor ribbon cable in accordance with claim 4 wherein said multiconductor ribbon cable includes at least one connector associated with said cable.

16. A multiconductor ribbon cable in accordance with claim 15 wherein said at least one connector is connected to one terminal end of said cable.

17. A multicondutor ribbon cable in accordance with claim 15 including at least a second connector mounted on said cable.

18. A multiconductor ribbon cable in accordance with claim 5 wherein said multiconductor ribbon cable includes at least one connector associated with said cable.

19. A multiconductor ribbon cable in accordance with claim 18 wherein said at least one connector is connected to one terminal end of said cable.

20. A multicondutor ribbon cable in accordance with claim 18 including at least a second connector mounted on said cable.

* * * * *